US005367804A

United States Patent [19]

Domberg et al.

[11] Patent Number: 5,367,804

[45] Date of Patent: Nov. 29, 1994

[54] INDICATING REGISTER

[75] Inventors: Hans Domberg, Hullhorst; Georg Seidel, Minden; Rolf Renner, Lubecke, all of Germany

[73] Assignee: Deutsche Wurlitzer GmbH, Hullhorst, Germany

[21] Appl. No.: 823,248

[22] Filed: Jan. 21, 1992

[30] Foreign Application Priority Data

Jan. 22, 1991 [DE] Germany ..... 4101738

[51] Int. Cl.[5] ..... B42F 17/20

[52] U.S. Cl. ..... 40/389; 40/531; 84/521

[58] Field of Search ..... 40/376, 389, 426, 492, 40/531, 509, 510, 511, 532, 449, 476; 84/517, 521

[56] References Cited

U.S. PATENT DOCUMENTS

| | | | |
|---|---|---|---|
| 1,508,572 | 9/1924 | Ord . | |
| 2,482,659 | 9/1949 | Davis et al. . | |
| 2,521,046 | 9/1950 | Darwin . | |
| 2,577,272 | 12/1951 | Sager . | |
| 2,601,501 | 6/1952 | Cain . | |
| 3,374,701 | 3/1968 | Wallenberg | 84/521 |
| 3,412,496 | 11/1968 | Hendricks et al. | 40/389 |
| 4,831,758 | 5/1989 | Williams et al. | 40/389 X |
| 5,031,346 | 7/1991 | Herring et al. | 40/510 X |
| 5,077,923 | 1/1992 | Rockola et al. | 40/510 |
| 5,136,562 | 8/1992 | Staar . | |

FOREIGN PATENT DOCUMENTS

| | | |
|---|---|---|
| 0138005 | 4/1985 | European Pat. Off. . |
| 274379 | 5/1914 | Germany . |
| 1017378 | 10/1957 | Germany . |

OTHER PUBLICATIONS

Abstract and drawing for 60-256969, Japan, date May 20, 1986.

Abstract and drawing for 62-256-261, Japan, date Apr. 26, 1988.

*Primary Examiner*—Brian K. Green

*Attorney, Agent, or Firm*—Merchant, Gould, Smith, Edell, Welter & Schmidt

[57] ABSTRACT

Presented is an indicating register that serves for indicating the content of magazine or the like, and having a simple and space-saving construction. Several pivotably-journaled pages each have a page appendage projecting from their pivot axis and offset relative to one another in the axial direction. A carrier unit is movable transversely to the pivot axes of the pages by means of a drive, and has several followers that are likewise axially offset to one another and additionally have a constant offset in the transport direction, and with movement of the carrier unit come into working engagement, one after the other, with the associated page appendages, and carry pages along until they run up against a previously turned page or against a stop.

11 Claims, 5 Drawing Sheets

INDICATING REGISTER

BACKGROUND OF THE INVENTION

The invention concerns an indicating register for indicating the content of magazines, storage units or the like, in particular for automatic music or video machines having several pivotably-journaled pages.

These types of indicating registers are known; for example, they find application in the case of automatic music machines for compact disks, where several compact disks or records are accommodated in one or several record magazines. With about 20 titles per page, capable of being represented in the indicating register in these automatic music machines are several thousand different titles, and are said to be capable of being easily selected by the user—according to his desired criteria—and then picked out and controlled for playback. Because of the large number of titles it is practical, for simpler orientation of the user, besides giving the title, to display in the indicating register still other additional information such as, for example, the large picture contained in the compact disk packaging with a representation of the interpreters (artists) or other prominent references. The indicating register must then display a corresponding size and should, at the same time, enable a clear arrangement of the information to be indicated, as well as a simple and clear operation.

SUMMARY OF THE INVENTION

Therefore, the object of the invention is to further develop an indicating register of the initially-mentioned type in a manner such that a large amount of information can be indicated easily and clearly—with simple operation.

In the case of the indicating register of the initially-mentioned type, this objective is satisfied by means of page appendages projecting radially from the pivot axes of the pages, which display a predetermined offset relative to one another in the axial direction, by a carrier unit that is movable transversely to the pivot axes of the pages, by means of a drive and by several followers on the carrier unit that display, relative to one another, an axial offset corresponding to the page appendages and a continuous offset in the transport direction, and which, with movement of the carrier unit, come into working engagement, one after the other, with the page appendages of the sequentially-following pages, and turn the pages over.

The advantages of the invention rest particularly in the fact that a greater number of pages, each with its own pivot axis, can be disposed parallel to one another, and that the carrier unit is movable transversely to these pivot axes and, thereby, brings the followers into working engagement with the corresponding page appendages, and in this manner turns the pages over. By this means, it is possible to arrange enough pages one behind the other such that it is also possible to put on the pages comprehensive information describing in detail the magazine or the storage unit. When using the indicating register for automatic music and video machines, besides the title information it is also possible, for example, to additionally apply visual or written information concerning the artists, etc. Additionally advantageous is that the indicating register can be expanded when needed—by adding additional pages—without it thereby becoming necessary to change other constructive components.

Particularly preferred, the carrier unit includes a carrier shaft that is parallel to the pivot axes of the pages, said shaft carrying the followers having the constant axial offset (a) and the constant circumferential offset (b), with the drive, with a transport movement of the carrier unit, driving the carrier shaft. Particularly preferred here, the carrier shaft includes a pinion, which, with rotation of the carrier shaft, runs along a gear rack extending in the transport direction, so that the rotation of the carrier shaft also causes movement of the carrier unit in the transport direction. Then, when the carrier shaft runs along the gear rack and, in so doing, rotates, the followers disposed on the carrier shaft then come, one after another, into working engagement with the page appendages and, in so doing, pivot the pages about their pivot axis until the pages come to a stop on the rest of the stack of pages, or on an appropriate deposit surface of a housing. The transporting movement of the carrier unit and the sequential engagement of the followers, in the case of this form of embodiment, follow in particularly simple and reliable fashion, because the transporting movement of the carrier unit and the sequential engagement movement of the followers is accomplished with only a single drive.

Particularly preferred, the followers or the page appendages are constructed in springy-elastic fashion in the transporting direction and come into touching-contact at the time of their mutual working engagement. With subsequent further movement of the carrier unit, the followers, respectively the page appendages, slide away from one another and—after turning the pages—again release the pages. In an alternate form of embodiment of the invention, the free ends of the followers, respectively of the page appendages, are provided with magnets, and the page appendages, respectively the followers, possess a magnetizable iron material. The followers are dimensioned such that the free ends terminate at a short distance from the page appendages, and when the followers move past the page appendages, then—because of the small air gap—produced as a working engagement is a magnetic coupling between followers and page appendages, which causes the page appendages, with movement of the carrier unit, to be moved over a part of the transport path the by followers, and thereby turn the pages. This form of embodiment of the invention has the special advantage that the pages—in any position of the carrier unit—can additionally also still be moved and turned manually, e.g. in order to change the information put on the pages, e.g. when the record magazines are refilled with other records. Due to the fact that the followers and page appendages are in a springy-elastic or a magnetic working engagement with one another, the pages can be manually stopped at any arbitrary point in time of movement runoff of the carrier unit and be filled with information or changed, without there being any need to fear damaging the indicating register.

BRIEF DESCRIPTION OF THE DRAWINGS

Advantageous further developments of the invention are characterized by the features of the subclaims. In the following.

DETAILED DESCRIPTION OF THE PREFERRED EMBODIMENT

Figure 1:
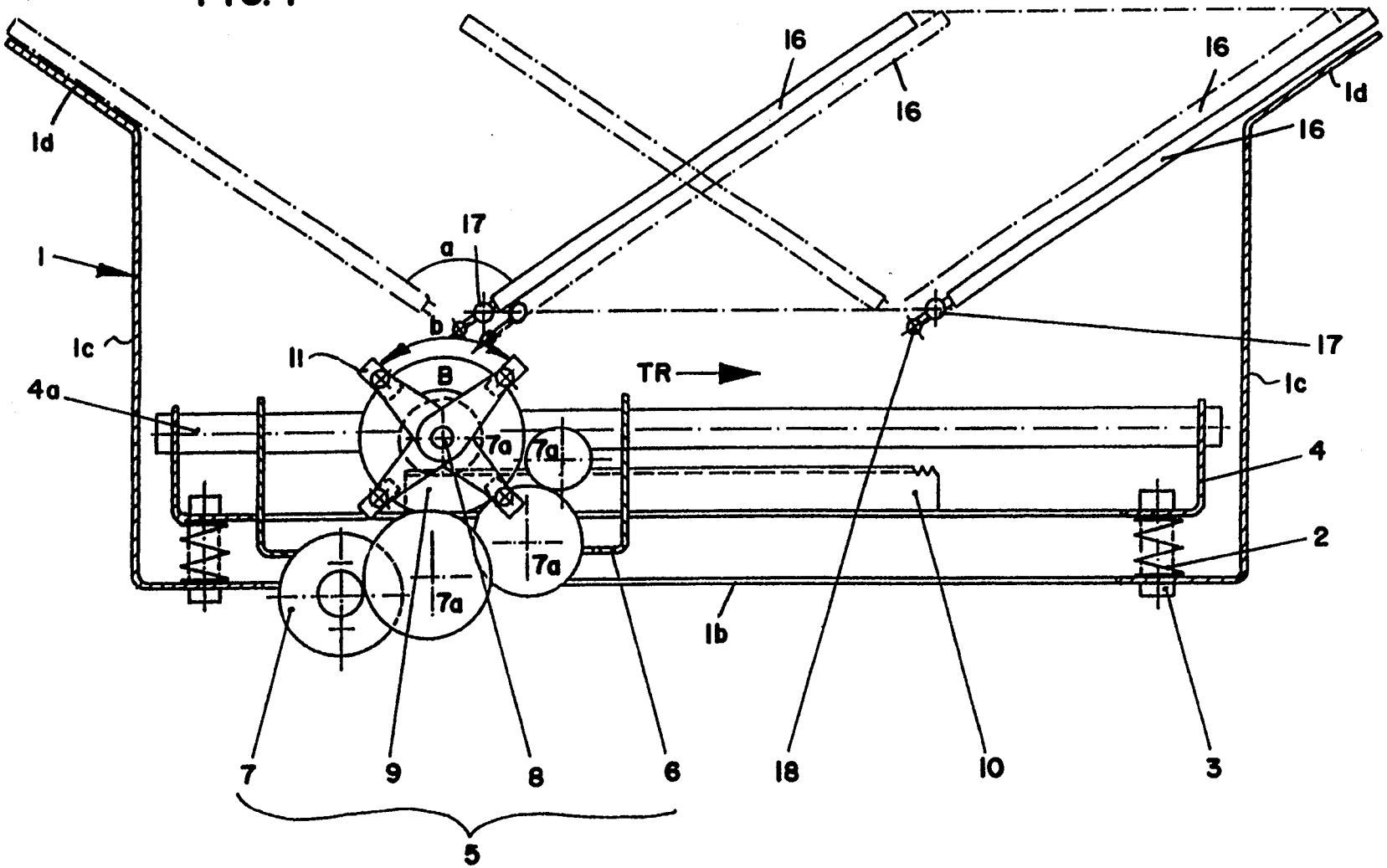
FIG. 1 shows a side view of the indicating register.
Figure 2:
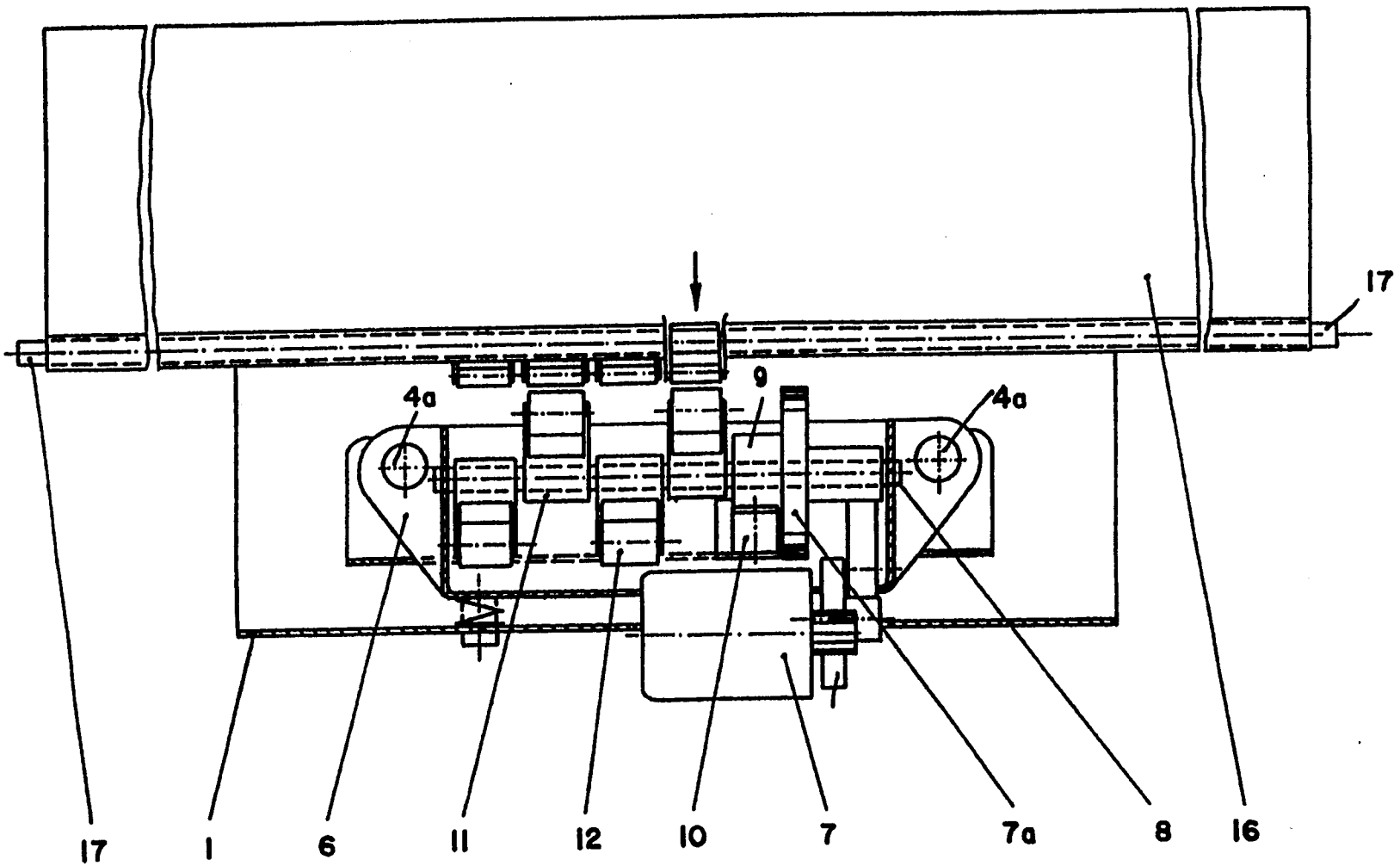
FIG. 2 shows a front view of the indicating register based on FIG. 1.
Figure 3:
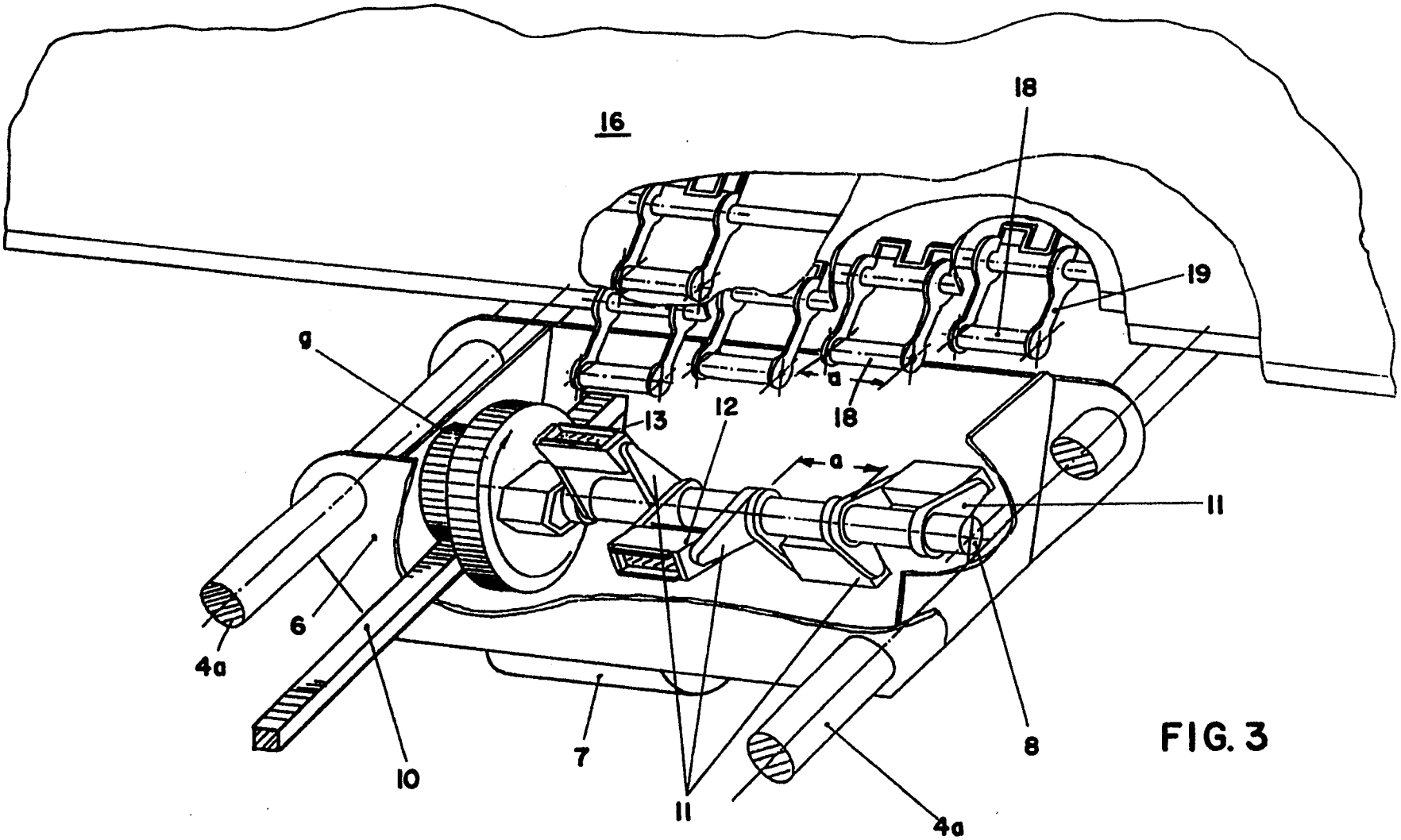
FIG. 3 shows an isometric view of the indicating register based FIG. 1 and 2.

FIGS. 1 to 3 show different views of an indicating register that serves for indicating the content of record magazines, in particular for automatic music or video machines. A housing 1 has a base 1*b*, two spaced-apart face walls 1*c*, which at their upper ends serve for limiting the turn-angle (a) of diverse pages 16 pivotably journaled inside the housing.

Journaled in springy fashion on the floor of the housing 1, on springs 2 that are guided on pins 3, is a mounting support 4. The mounting support is constructed as a U-shaped piece of sheet metal, which supports parallel guide rods 4*a* on the lateral arms. Fastened to the base of the mounting support 4, parallel to the guide rods 4*a*, is a gear rack 10. Arranged in displaceable fashion on the guide rods is a carrier unit 5 that displays a drive consisting of a motor 7, a transmission (gear box) 7*a* and a pinion 9 seated on a carrier shaft 8, with the pinion 9 cooperating with the gear rack 10. Therefore, when activating the motor 7, the carrier shaft 8 is driven by tile transmission 7*a*, so that the pinion 9 located on this shaft 8 runs along the gear rack 10 and, therewith, displaces the carrier unit 5 on the gear rack 10 in a direction along the guide rods 4*a* which depends on the direction of rotation of the motor.

The carrier unit 5 also includes a support 6 that supports the motor 7, the transmission 7*a*, and the carrier shaft 8. The support 6 is displaceably and longitudinally mounted on the guide rods 4*a*.

Figure 5:
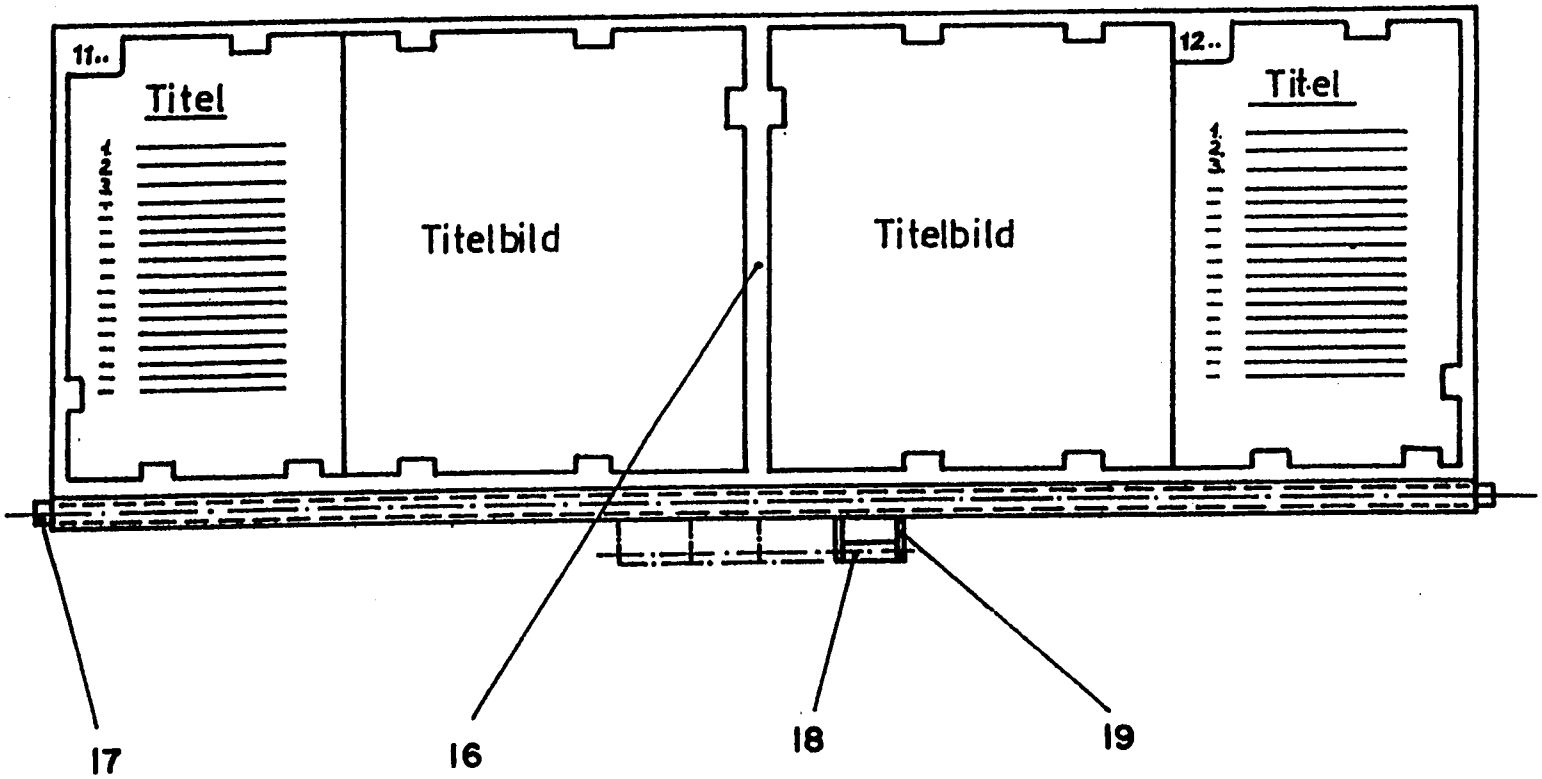
FIG. 5 shows the front view of a page of the indicating register.

As can be obtained in particular from FIG. 1, FIG. 3, and FIG. 5, each page has, on one longitudinal edge, a pivot axis 17. Various pages 16 are pivotably journaled parallel to one another inside the housing, or in adjacent, other device parts, with their associated pivot axis 17 at a predetermined distance from the guide rods 4*a*. The pivot axes 17 run parallel to one another, at a predetermined distance apart, transversely to the guide rods 4*a*. The pages 16 can be turned or leafed over from the one end position, about the pivot angle (a), into their other end position, with the end positions being established by the bent, free ends 1*d* of the two face walls of the housing 1, or by any other whatsoever limit stops.

As can be obtained in particular from FIG. 1 to 4, the pages 16 have page appendages 18 projecting radially from the pivot axes 17, which display relative to one another in the axial direction of the pivot axes a predetermined offset (a). The carrier unit 5 has several followers 11, which are arranged on the carrier shaft 8, and have a constant axial displacement (a) corresponding to the page appendages 18. Additionally, between two adjacent followers 11, there is an offset (b) and an offset-angle (B) in the circumferential direction of the shaft 8. The followers 11 have at their free ends magnets that are rotatably journaled about axes running parallel to the carrier shaft 8. The page appendages 18 consist of magnetizable iron and extend radially only far enough from their pivot axis 17, toward the carrier unit 5, so that there remains between the free ends of the followers 11 and the free ends of the page appendages 18 a small interval when the followers 11 move in the transport direction past the associated page appendages 18.

Figure 4:
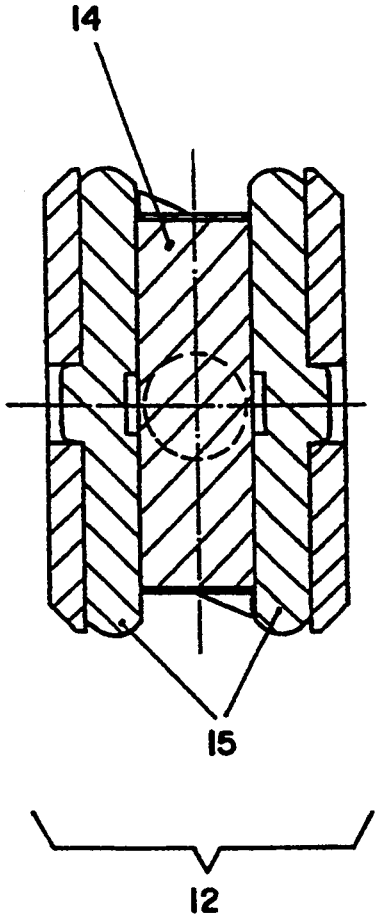
FIG. 4 shows a cross section through a magnet of a follower.

As is represented in particular in FIG. 4, the magnets 12 that are rotatably journaled at the free ends of the followers 11 are constructed from a permanent magnet 14 that is encased on both sides by pole shoes 15. The page appendages 18 in FIGS. 3 and 4 are constructed as rollers, which are journaled parallel to the pivot axes 17 on two arms 19 extending radially from the pivot axes 17.

When the motor 7, via the transmission 7*a*, sets the carrier shaft 8 into a rotating movement, and the pinion 9 and the gear rack 10 displace the entire carrier unit 5 in the transport direction along the guide rods 4*a*. The adjacent followers 11 then move cyclically one after the other, at a snort distance apart, past the pages 16 corresponding to the page appendages 18. In so doing, the followers 11, via the magnetic coupling occurring in each case between magnet 12 and page appendage 18, move into a working engagement with the page appendages and carry the page appendages along in the transport direction—without touching contact or even forming closure—, whereby the pages concerned are turned by the amount of turn-angle (a). With further movement of the followers in the transport direction, the magnetic coupling, i.e. the working engagement, is again ended when the pages come to rest against appropriate stops and/or the already-turned pages. Since the turning movement is accomplished without forming closure between followers 11 and page appendages 18, the individual pages can be manually stopped at any point in time of their movement, filled with new legends, information, pictures, etc., and next be manually brought into an end position without, in so doing, the operation and structure of the indicating register receiving any injury or damage.

We claim:

1. Indicating register for indicating contents of magazines, storage units, in particular for automatic music, video machines, the indicating register comprising:

a plurality of pivotally-journaled pages;

a plurality of page appendages projecting radially from pivot axes of the pivotally-journaled pages, the page appendages having a predetermined offset between each other in an axial direction; and a carrier unit being moved transversely to the pivot axes of the pages, the carrier unit including drive means for moving the carrier unit transversely and a plurality of followers disposed on the carrier unit, two adjacent followers having an axial offset between each other which corresponds to the predetermined offset of the page appendages, two adjacent followers having a constant offset between each other, the followers corresponding with the page appendages one by one and turning over the pivotally-journaled pages one by one with transverse movement of the carrier unit.

2. Indicating register according to claim 1, wherein the carrier unit further includes a carrier shaft parallel to the pivot axes of the pivotally-journaled pages, the carrier shaft carrying the followers, the drive means interconnecting with the carrier shaft and driving the carrier shaft.

3. Indicating register according to claim 1, wherein the followers and the page appendages are elastic in the transport direction, the followers and the page appendages come into contact at the time of a mutual working engagement, wherein the followers, when moving, touch the page appendages, pivot the page appendages about the pivot axes, and release the page appendages.

4. Indicating register according to claim 1, wherein a free end of each follower includes a magnet, a corresponding free end of each page appendage being made of magnetic iron material, the free ends of the follower and the page appendage being magnetically coupled to each other, the followers terminating at a distance from the free end of the page appendage and turning over the pivotally-journaled pages.

5. Indicating register according to claim 4, wherein a pinion is disposed on a carrier shaft, a gear rack engaged with the pinion extends in the transport direction, the pinion rotates along the gear rack when the carrier unit moves in the transport direction.

6. Indicating register according to claim 5, wherein the carrier unit further includes a first support and the carrier shaft, the first support supporting the drive means and the carrier shaft, the carrier shaft being parallel to the pivot axes of the pivotally-journaled pages, the carrier shaft carrying the followers, the drive means interconnecting with the carrier shaft and driving the carrier shaft, the first support being displaceably and longitudinally mounted on a plurality of guide rods.

7. Indicating register according to claim 6, wherein the guide rods and the gear rack are fixed on a second support, the second support being mounted on a housing by spring means.

8. Indicating register according to claim 7, wherein the pivot axes of the pivotally-journaled pages are parallel to each other at a predetermined space apart from each other and are transverse to the guide rods.

9. Indicating register according to claim 8, wherein the magnet at the free end of each follower is rotatably journaled about an axis parallel to the carrier shaft.

10. Indicating register according to claim 9, wherein the magnet has a permanent magnet core and a plurality of external pole pieces.

11. Indication register for indicating contents of magazine, storage units, in particular for automatic music, video machines, the indicating register comprising:

a plurality of pivotally-journaled pages;

a plurality of page appendages projecting radially from pivot axes of the pivotally-journaled pages, the page appendages having a predetermined offset between each other in an axial direction;

a carrier unit being moved transversely to the pivot axes of the pages, the carrier unit including drive means for moving the carrier unit transversely and a plurality of followers disposed on the carrier unit, two adjacent followers having an axial offset between each other which corresponds to the predetermined offset of the page appendages, two adjacent followers having a constant offset between each other, the followers corresponding with the page appendages one by one and turning over the pivotally-journaled pages one by one with transverse movement of the carrier unit; and wherein a free end of each follower includes a magnet, a corresponding free end of each page appendage being made of magnetic iron material, the free ends of the follower and the page appendage being magnetically coupled to each other, the followers terminating at a distance from the free end of the page appendage and turning over the pivotally-journaled pages.

* * * * *

UNITED STATES PATENT AND TRADEMARK OFFICE
CERTIFICATE OF CORRECTION

PATENT NO. : 5,367,804

DATED : November 29, 1994

INVENTOR(S) : Hans Domberg, et al.

It is certified that error appears in the above-identified patent and that said Letters Patent is hereby corrected as shown below:

On the title page: Inventors, item: [75], "Lubecke" should be --Lubbecke--; and in the priority information field [30], "4101738" should be -- 4101738.2--.

Abstract, line 2, "magazine" should be --magazines--.

In column 6, line 52, "FIG. should be --FIGS.--.

In column 6, line 7 (Claim 11), "Indication" should be --Indicating--; and in lines 7 and 8, "magazine" should be --magazines--.

Signed and Sealed this

Twenty-eighth Day of November 1995

*Attest:*

*Attesting Officer*

BRUCE LEHMAN

*Commissioner of Patents and Trademarks*